US010810930B2

(12) United States Patent
Shim et al.

(10) Patent No.: US 10,810,930 B2
(45) Date of Patent: Oct. 20, 2020

(54) ELECTROLUMINESCENCE DISPLAY DEVICE AND METHOD FOR DRIVING THE SAME

(71) Applicant: LG DISPLAY CO., LTD., Seoul (KR)

(72) Inventors: DongSup Shim, Goyang-si (KR); Byeongjun Kim, Busan (KR); Kyoungwon Lee, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 43 days.

(21) Appl. No.: 15/822,025

(22) Filed: Nov. 24, 2017

(65) Prior Publication Data

US 2018/0151109 A1 May 31, 2018

(30) Foreign Application Priority Data

Nov. 25, 2016 (KR) ..... 10-2016-0158097

(51) Int. Cl.

| | |
|---|---|
| ***G09G 3/32*** | (2016.01) |
| ***G09G 3/3233*** | (2016.01) |
| ***G09G 3/20*** | (2006.01) |

(52) U.S. Cl.

CPC ..... *G09G 3/32* (2013.01); *G09G 3/3233* (2013.01); *G09G 3/2014* (2013.01); *G09G 2300/0861* (2013.01); *G09G 2310/0262* (2013.01); *G09G 2310/08* (2013.01); *G09G 2320/0233* (2013.01);

(Continued)

(58) Field of Classification Search

CPC ..... G09G 3/32; G09G 2300/0861; G09G 2340/0435

See application file for complete search history.

(56) References Cited

U.S. PATENT DOCUMENTS

2011/0057917 A1* 3/2011 Ryu ..... G09G 3/3266 345/211
2013/0194199 A1* 8/2013 Lynch ..... G06F 3/0412 345/173
2013/0307634 A1 11/2013 Chin et al.

(Continued)

FOREIGN PATENT DOCUMENTS

CN 101779229 A 7/2010
CN 102542980 A 7/2012

(Continued)

*Primary Examiner* — Priyank J Shah

(74) *Attorney, Agent, or Firm* — Birch, Stewart, Kolasch & Birch, LLP

(57) ABSTRACT

There is provided an electroluminescence display device and driving method thereof. The electroluminescence display device can include an electroluminescence element in each of a plurality of pixels, a pixel driving circuit for driving the electroluminescence element, a gate driver and a data driver for generating signals for driving the pixel driving circuit to be switchable between a first refresh rate and a second refresh rate, and an emission signal generator for generating an emission signal having a first duty ratio supplied to the pixel driving circuit when the pixel driving circuit is driven at the first refresh rate and generating the emission signal having a second duty ratio supplied to the pixel driving circuit when the pixel driving circuit is driven at the second refresh rate. Accordingly, uniform brightness can be displayed regardless of the driving refresh rate for reducing the recognizable image distortion phenomenon.

19 Claims, 9 Drawing Sheets

(52) U.S. Cl.
CPC ..... *G09G 2320/0247* (2013.01); *G09G 2340/0435* (2013.01)

(56) References Cited

U.S. PATENT DOCUMENTS

| | | | | |
|---|---|---|---|---|
| 2016/0098962 | A1 | 4/2016 | Shibazaki | |
| 2016/0124491 | A1* | 5/2016 | An | G09G 3/3233 713/323 |
| 2017/0004766 | A1* | 1/2017 | Cho | G09G 3/3266 |
| 2017/0092196 | A1* | 3/2017 | Gupta | G09G 3/3233 |
| 2017/0337889 | A1* | 11/2017 | Wei | G09G 3/3648 |
| 2018/0004340 | A1* | 1/2018 | Yeh | G06F 3/0416 |

FOREIGN PATENT DOCUMENTS

| | | | |
|---|---|---|---|
| CN | 102568410 | A | 7/2012 |
| CN | 103597534 | A | 2/2014 |
| CN | 104640330 | A | 5/2015 |
| CN | 105096797 | A | 11/2015 |
| CN | 105103214 | A | 11/2015 |
| CN | 106558285 | A | 4/2017 |
| JP | 2006-30516 | A | 2/2006 |
| KR | 10-2014-0133326 | A | 11/2014 |
| WO | WO 2017/05840 | A1 | 4/2017 |

* cited by examiner

ELECTROLUMINESCENCE DISPLAY DEVICE AND METHOD FOR DRIVING THE SAME

CROSS REFERENCE TO RELATED APPLICATIONS

This application claims the priority benefit of the Korean Patent Application No. 10-2016-0158097 filed on Nov. 25, 2016 in the Republic of Korea, which is hereby incorporated by reference as if fully set forth herein.

BACKGROUND

Technical Field

The present disclosure relates to an electroluminescence display device and a driving method thereof, and more in detail, to an electroluminescence device apparatus which may compensate a flicker by maintaining a uniform brightness of a pixel even when a refresh rate varies.

Related Technology

A flat panel display (FPD) has been implemented in various electronic devices such as mobile phones, tablets, laptop computers, televisions, monitors and the like. Recently, a liquid crystal display (LCD) device and an electroluminescence display (ELD) are regarded as flat panel displays (FPDs). Such a display device includes a pixel array including a plurality of pixels, in which an image is displayed with a plurality of pixels and a driving circuit that controls light to be transmitted or emitted in each of the plurality of pixels. A driving circuit of a display device includes a data driving circuit for supplying a data signal to data lines of a pixel array, a gate driving circuit (i.e., scan driving circuit) for supplying a gate signal (i.e., a scan signal) synchronized with the data signal sequentially supplied to gate lines (i.e., scan lines) and a timing controller for controlling the data driving circuit and the gate driving circuit.

Recently, a variable refresh rate (VRR) technique is required as one of various functions required for a display device. VRR is a technique for driving a pixel by driving at a certain refresh rate, increasing the refresh rate at a time when high-speed driving is required, and lowering the refresh rate at a time when low power consumption and/or low-speed driving may be required.

When the refresh rate varies according to the VRR, the viewer may recognize that the refresh rate varies. Accordingly, it is required that the viewer should not recognize varying refresh rate, that is, the image quality degradation due to the refresh rate variation needs to be reduced.

SUMMARY

The inventors of the present disclosure have continued research to reduce image distortions in an electroluminescent display device that can operate at a variable refresh rate as described above.

Generally, solutions for solving problems such as image distortion and flicker, which may occur when a variable refresh rate is applied in a liquid crystal display device, and in detail, solutions for changing the driving method tend to be difficult to apply to electroluminescent display devices. This may be related to the difference that the liquid crystal display device requires a light source to emit light and the electroluminescent display device is self-emissive.

In detail, the inventors of the present disclosure have recognized that when applying a variable refresh rate in an electroluminescence display, a luminance difference occurs by different refresh rates according to various refresh rates driving technique of pixels.

Furthermore, the inventors of the present disclosure invented an electroluminescent display device and a driving method thereof in which the luminance difference can be reduced at different refresh rates even when a variable refresh rate is applied in the electroluminescent display device.

Accordingly, an object of the present disclosure is to provide an electroluminescent display device and a driving method thereof, in which the brightness of a pixel is maintained when driving of a pixel is changed from one refresh rate to another refresh rate.

And, another object of the present disclosure is to provide an electroluminescent display device and a driving method thereof, in which can gradually change its luminance so that the viewer substantially cannot recognize the change of the refresh rate when the driving of the pixel is changed from one refresh rate to another refresh rate.

It should be noted that objects of the present disclosure are not limited to the above-described objects and other objects of the present disclosure will be apparent to those skilled in the art from the following descriptions.

According to an aspect of the present disclosure, there is provided an electroluminescence display device. The electroluminescence display device comprises an electroluminescence element in each of a plurality of pixels, a pixel driving circuit driving the electroluminescence element, a gate driver and a data driver generating signals for driving the pixel driving circuit to be switchable between a first refresh rate and a second refresh rate different from the first refresh rate, and an emission signal generator generating an emission signal having a first duty ratio different from the first duty ratio, supplied to the pixel driving circuit when the pixel driving circuit is driven at the first refresh rate and generating the emission signal having a second duty ratio supplied to the pixel driving circuit when the pixel driving circuit is driven at the second refresh rate.

According to another aspect of the present disclosure, there is provided a driving method for an electroluminescence display device. The driving method of the electroluminescence display device include an electroluminescence element arranged in each of a plurality of pixels and a pixel driving circuit configured to drive the electroluminescence element. The driving method of the electroluminescence display device can include driving the pixel driving circuit at a first refresh rate, supplying an emission signal having a first duty ratio to the pixel driving circuit when the pixel driving circuit is driven at the first refresh rate, driving the pixel driving circuit by switching the pixel driving circuit driven at the first refresh rate to a second refresh rate different from the first refresh rate and supplying an emission signal having a second duty ratio different from the first duty ratio to the pixel driving circuit when the pixel driving circuit is driven at the second refresh rate.

The details of other embodiments are included in the detailed description and accompanying drawings.

The present disclosure can provide an electroluminescence display device and a driving method thereof that can reduce the image deterioration phenomenon by maintaining the brightness of the pixel regardless of the driving refresh rate when the driving of a pixel is changed from one refresh rate to another refresh rate.

In addition, the present disclosure can provide an electroluminescence display device and a driving method thereof with improved image quality by sequentially changing the degree of the brightness to reduce perception of a viewer in terms of varying refresh rate.

It should be noted that the effects of the present disclosure are not limited to those described above and other effects of the present disclosure are included in the following descriptions.

BRIEF DESCRIPTION OF THE DRAWINGS

The above and other aspects, features and other advantages of the present disclosure will be more clearly understood from the following detailed description taken in conjunction with the accompanying drawings, in which.

Figure 3A:
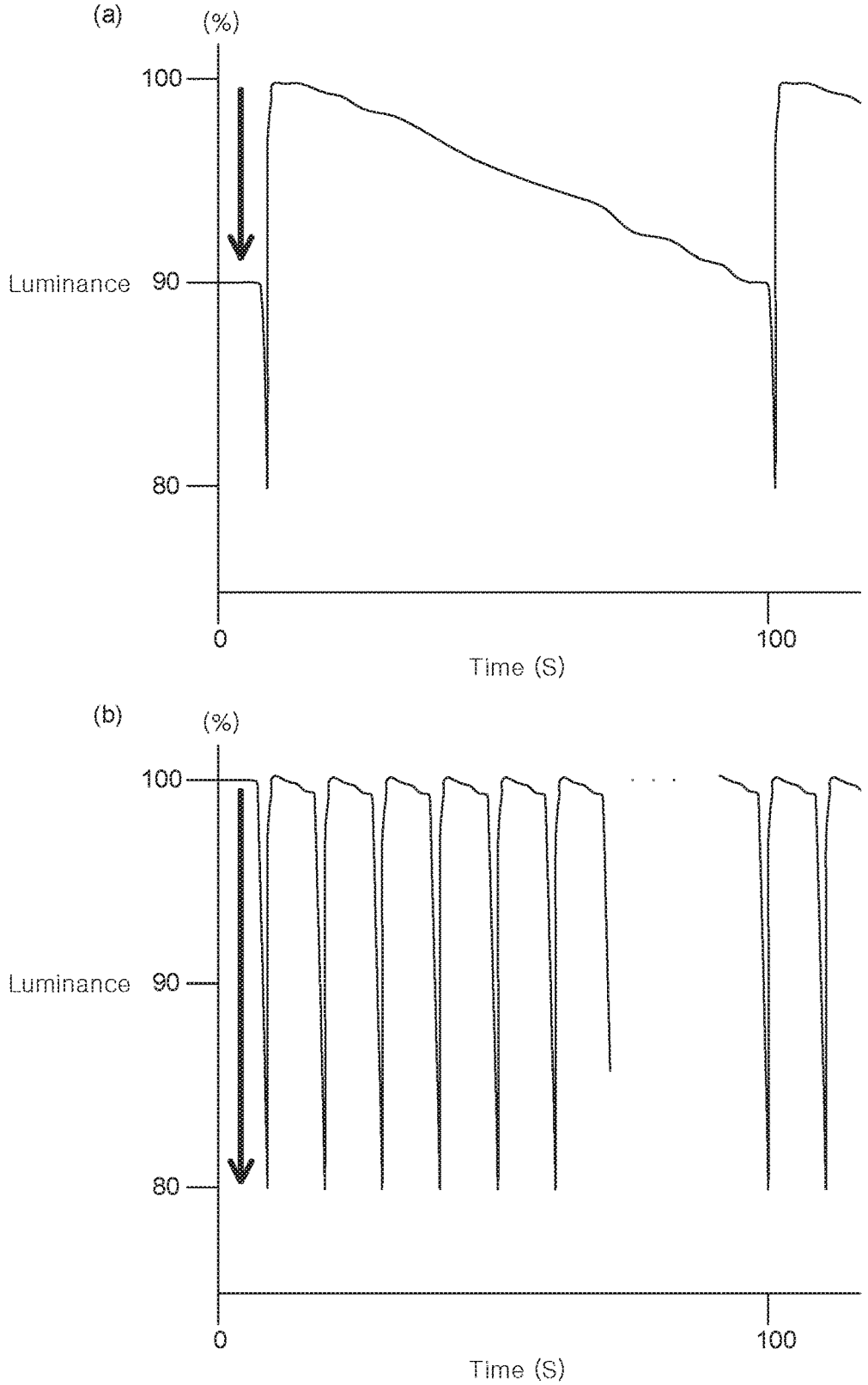
Figure 3B:
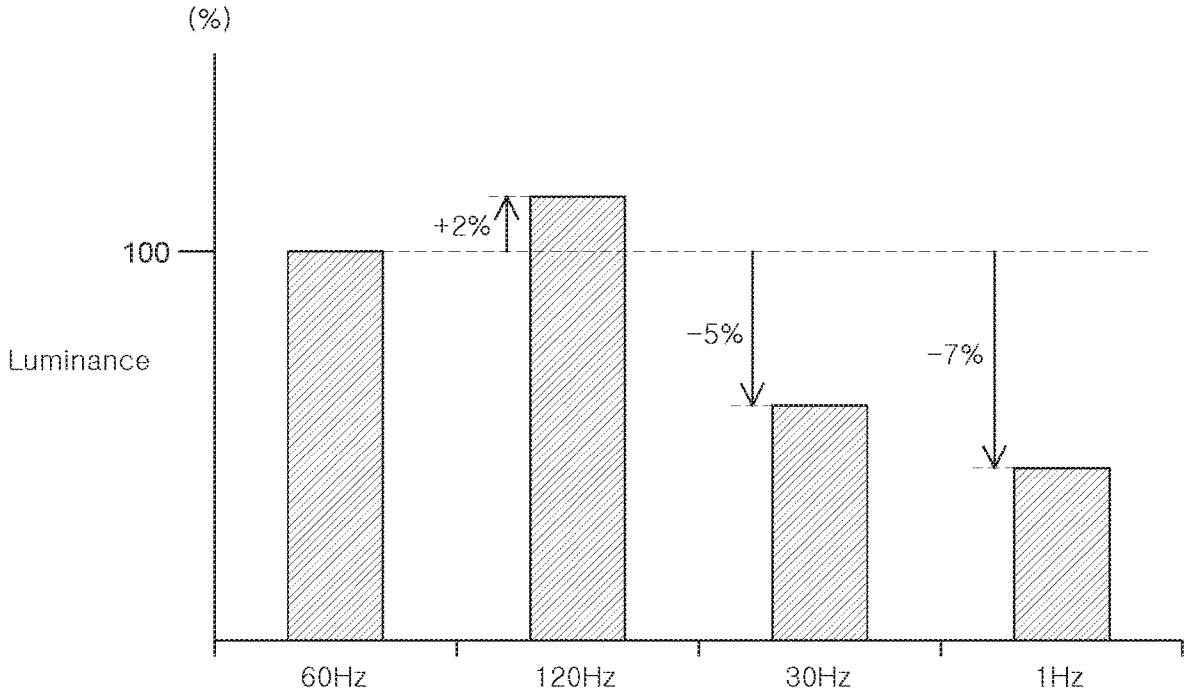
Figure 4:
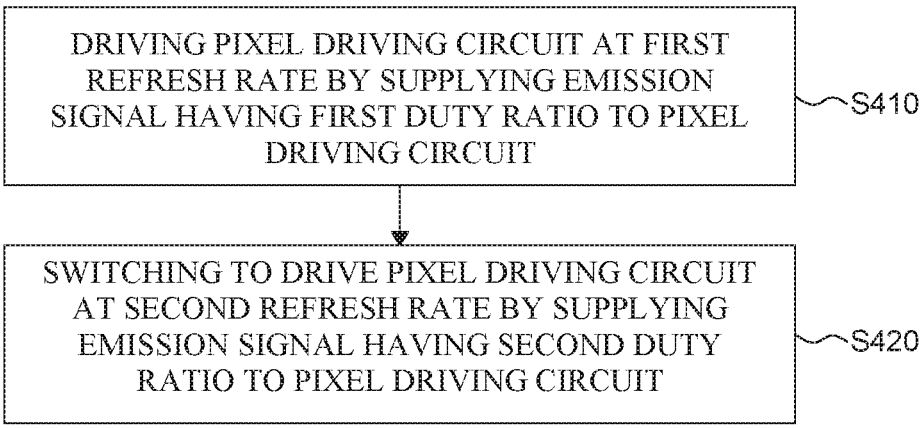
Figure 5:
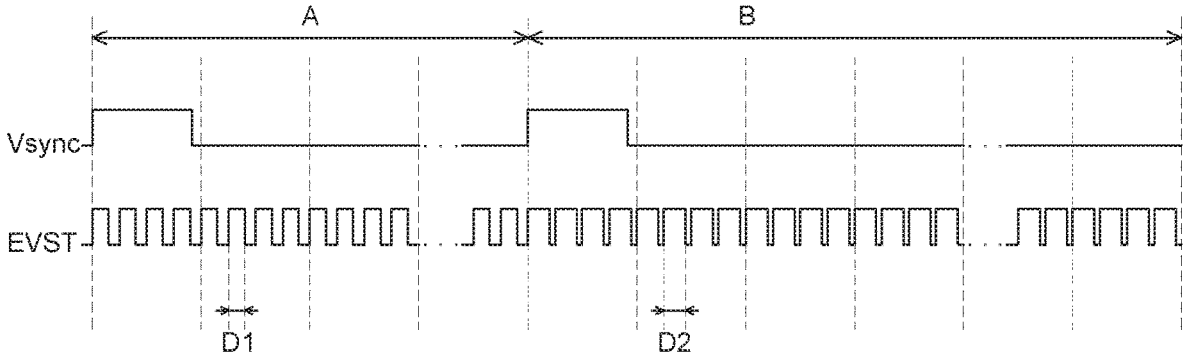
Figure 6:
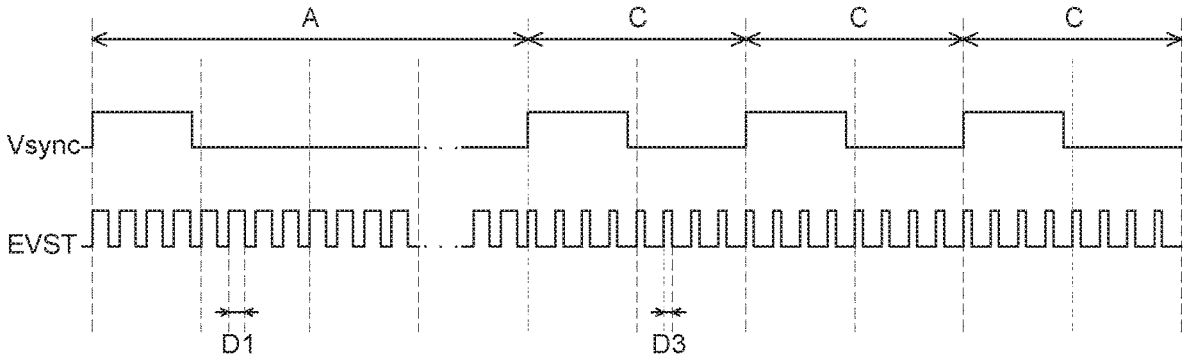
Figure 7:
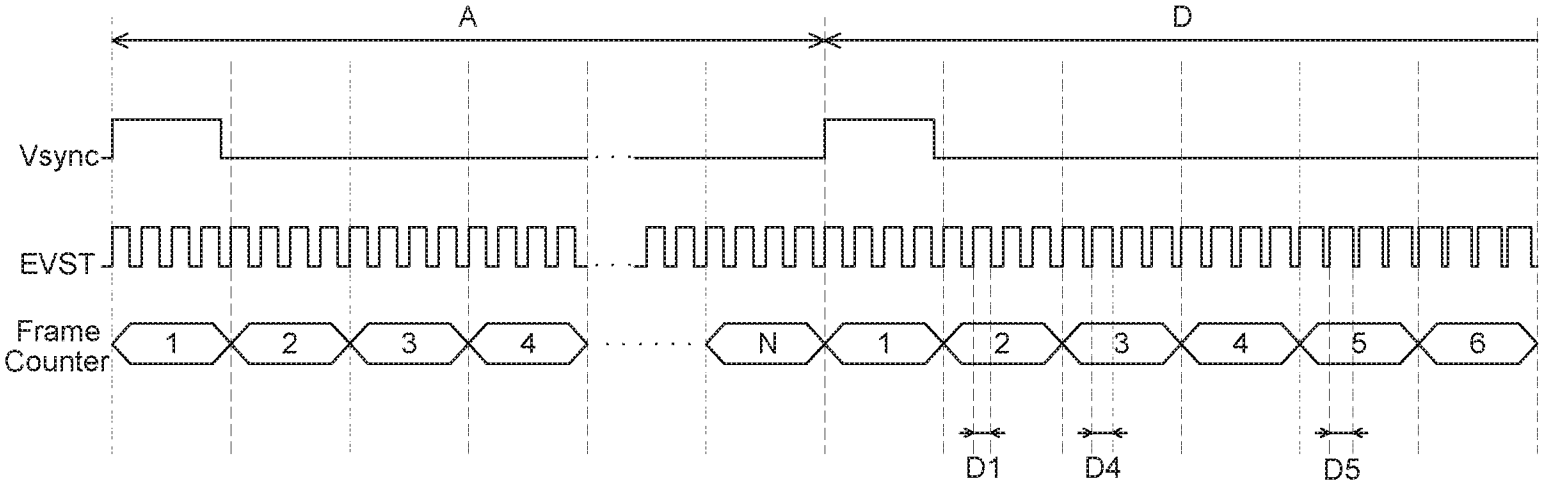
Figure 8:
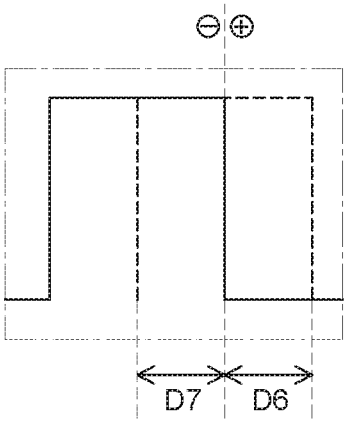
Figure 9:
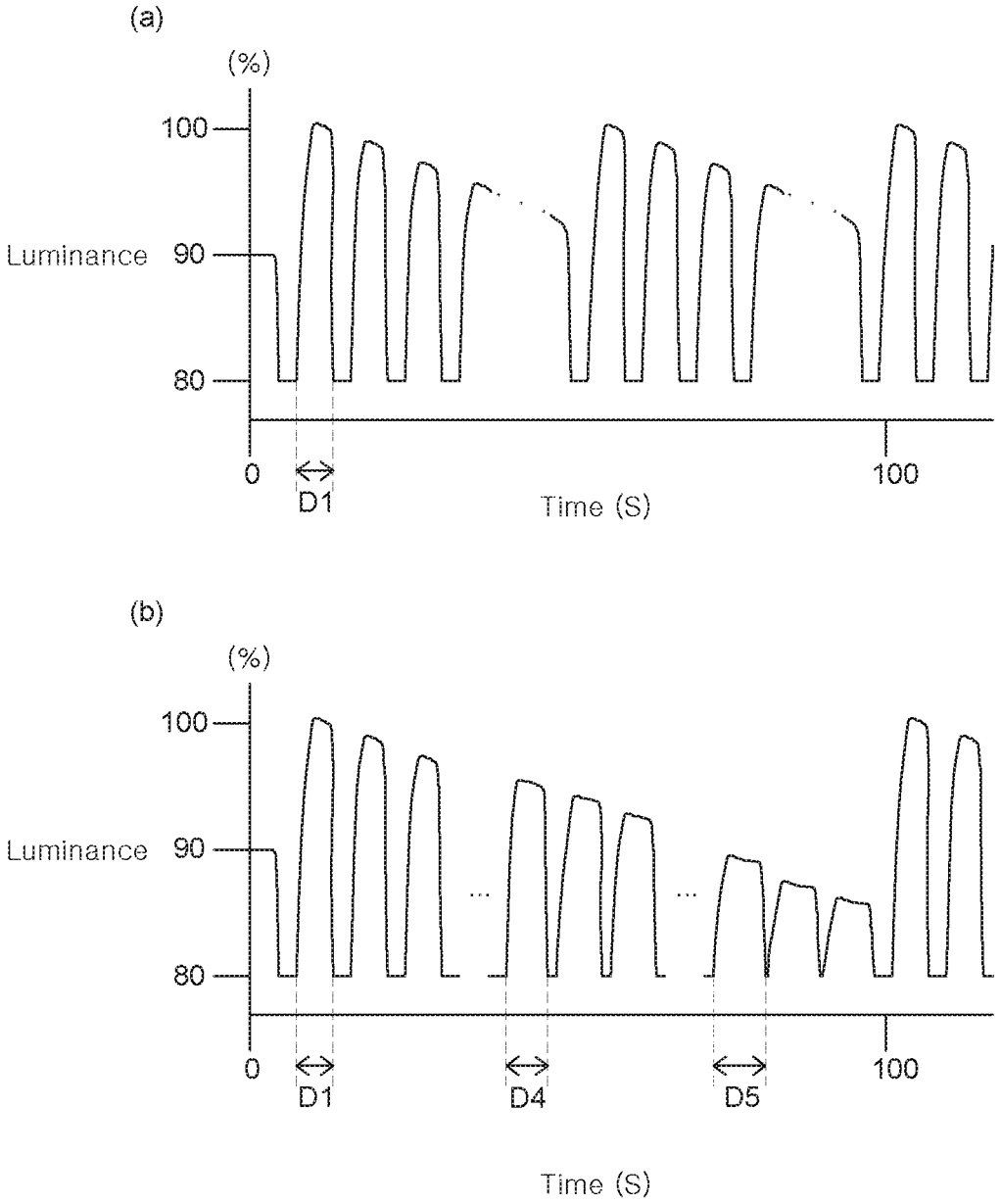

(a) of FIG. 3A is a graph illustrating a change in brightness according to a voltage drop in a pixel of an electroluminescence display according to an embodiment of the present disclosure;

(b) of FIG. 3A is a graph showing a change in brightness according to the refresh initialization in the electroluminescence display device;

FIG. 3B is a graph showing a change in brightness of a pixel when a refresh rate is changed in a general electroluminescence display device;

FIG. 4 is a schematic flowchart illustrating a driving method of an electroluminescence display according to an embodiment of the present disclosure;

FIG. 5 is an input-output waveform diagram of a vertical synchronization signal and an emission signal of an electroluminescence display according to an embodiment of the present disclosure;

FIG. 6 is an input-output waveform diagram of a vertical synchronization signal and an emission signal of an electroluminescence display according to another embodiment of the present disclosure;

FIG. 7 is an input-output waveform diagram of a vertical synchronization signal and an emission signal of an electroluminescence display according to an embodiment of the present disclosure;

FIG. 8 is a schematic diagram for explaining pulse width modulation (PWM) of a light-emitting pixel when a refresh rate is varied in an electroluminescence display according to various embodiments of the present disclosure; and FIG. 9 is a graph showing a change in brightness of a pixel when changing the refresh rate in an electroluminescence display according to various embodiments of the present disclosure.

DETAILED DESCRIPTION OF THE PRESENT DISCLOSURE

Advantages and features of the present disclosure and methods for accomplishing the same will be more clearly understood from embodiments described below with reference to the accompanying drawings. However, the present disclosure is not limited to the following embodiments but may be implemented in various different forms. The embodiments are provided only to complete disclosure of the present disclosure and to fully provide a person having ordinary skill in the art to which the present disclosure pertains with the category of the invention and the present invention will be defined by the appended claims.

The shapes, sizes, ratios, angles, numbers and the like illustrated in the accompanying drawings for describing the embodiments of the present disclosure are merely examples and the present disclosure is not limited thereto. Like reference numerals generally denote like elements throughout the present specification. Further, in the following description, a detailed explanation of known related technologies may be omitted to avoid unnecessarily obscuring the subject matter of the present disclosure. The terms such as "including", "having", "comprising" and "consist of" used herein are generally intended to allow other components to be added unless the terms are used with the term "only". Any references to singular may include plural unless expressly stated otherwise.

Components are interpreted to include an ordinary error range or an ordinary tolerance range even if not expressly stated.

When the position relation between two parts is described using the terms such as "on", "above", "below" and "next", on or more parts may be positioned between the two parts unless the terms are used with the term "immediately" or "directly".

Although the terms "first", "second" and the like are used for describing various components, these components are not confined by these terms. These terms are merely used for distinguishing one component from the other components. Therefore, a first component to be mentioned below may be a second component in a technical concept of the present disclosure.

Throughout the whole specification, the same reference numerals denote the same elements.

Since size and thickness of each component illustrated in the drawings are represented for convenience in explanation, the present disclosure is not necessarily limited to the illustrated size and thickness of each component.

The features of various embodiments of the present disclosure can be partially or entirely bonded to or combined with each other and can be interlocked and operated in technically various ways as can be fully understood by a person having ordinary skill in the art and the embodiments can be carried out independently of or in association with each other.

Various embodiments of the present disclosure will be described in detail with reference to the accompanying drawings.

Figure 1:
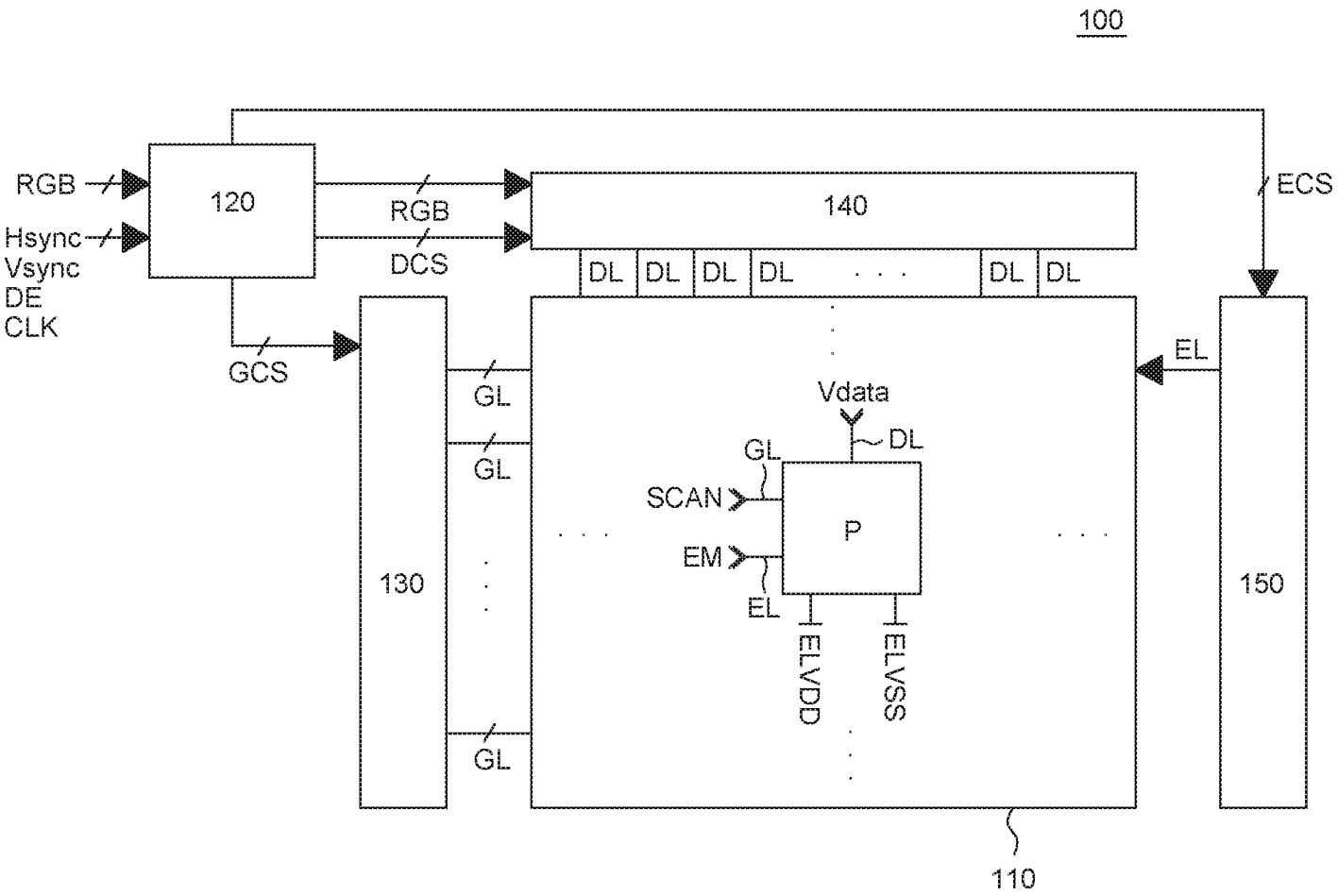
FIG. 1 is a block diagram schematically showing an electroluminescence display device according to an embodiment of the present disclosure.

FIG. 1 is a block diagram schematically showing an electroluminescence display device according to an embodiment of the present disclosure. All the components of the electroluminescence display device according to all embodiments of the present disclosure are operatively coupled and configured.

Referring to FIG. 1, an electroluminescence display device 100 includes a display panel 110 including a plurality of pixels, a gate driver 130 for supplying a gate signal to each of the plurality of pixels, a data driver 140 for supplying a data signal to each of the plurality of pixels, an emission signal generator 150 for supplying a light emission signal to each of the plurality of pixels, and a timing controller 120.

The timing controller 120 processes image data (RGB) input from the outside in accordance with the size and the resolution of the display panel 110 and supplies the processed image data to the data driver 140. The timing controller 120 generates a gate signal, a data signal, and an emission control signal (GCS, DCS, and ECS) with synchronizing signals SYNC inputted from the outside such as the dot clock signal CLK, the data enable signal DE, the horizontal synchronizing signal Hsync and the vertical synchronizing signal Vsync. By supplying the generated the gate signal, the data signal, and the emission control signal (GCS, DCS, ECS) to the gate driver 130, the data driver 140, and the emission signal generator 150, the gate driver 130, the data driver 140 and the emission signal generator 150 are controlled.

The timing controller 120 may be configured in combination with various processors, for example, a microprocessor, a mobile processor, an application processor, and the like depending on the device to be mounted.

The timing controller 120 generates signals so that the pixels can be driven at various refresh rates. That is, the timing controller 120 generates signals related to driving such that the pixels are driven at a variable refresh rate or switchable between a first refresh rate and a second refresh rate. For example, the timing controller 120 may simply change the speed of the clock signal, generate a synchronizing signal to produce a horizontal blank or a vertical blank, or driving the gate driver 130 with mask type, therefore the pixels may be driven at various refresh rates.

And, the timing controller 120 generates various signals for driving the pixel driving circuit at a first refresh rate. In detail, when driven at a first refresh rate, the emission signal generator 150 generates a light emission control signal ECS to generate an emission signal EM having a first duty ratio. Thereafter, the timing controller 120 operates to drive the pixel driving circuit at a second refresh rate, and generating various signals for driving at the second refresh rate, and in detail, when driven at the second refresh rate, the emission signal generator 150 generates the emission control signal ECS to generate the emission signal EM having the second duty ratio different from the first duty ratio.

The gate driver 130 supplies the scan signal SCAN to the gate line GL in accordance with the gate control signal GCS supplied from the timing controller 120. Although the gate driver 130 is shown as being disposed on one side of the display panel 110 in FIG. 1, the number and arrangement of the gate drivers 130 are not limited thereto. Therefore, the gate driver 130 may be disposed on one side or both sides of the display panel 110 in a gate in panel (GIP) type.

The data driver 140 converts the image data RGB to the data voltage Vdata in accordance with the data control signal DCS supplied from the timing controller 120 and supplies the converted data voltage Vdata to the pixels with the data line DL.

A plurality of gate lines GL, a plurality of emission lines EL and a plurality of data lines DL may be intersected with each other in the display panel 110. Each pixel is connected to a gate line GL and a data line DL. In detail, one pixel receives a gate signal from the gate driver 130 through the gate line GL, a data signal from the data driver 140 through the data line DL, an emission signal from the emission line EL and various power sources through the power supply line. Here, the gate line GL supplies the scan signal SCAN, the emission line EL supplies the emission signal EM, and the data line DL supplies the data voltage Vdata. According to various embodiments, the gate line GL may include a plurality of scan signal lines, and the data line DL may further include a reference voltage line Vref. And, the emission line EL may also include a plurality of emission signal lines. And, one pixel may receive the high potential voltage ELVDD and the low potential voltage ELVSS through the power supply line.

And, each of the pixels includes an electroluminescence element and a pixel driving circuit for driving the electroluminescence element. Here, the electroluminescence element comprises an anode, a cathode, and an organic emission layer between the anode and the cathode. The pixel driving circuit includes a plurality of switching elements, a driving switching element, and a capacitor. Here, the switching element may be a thin film transistor (TFT). In the pixel driving circuit, the driving TFT controls the degree of brightness (e.g., amount of emission) of the electroluminescence element by controlling the amount of current supplied to the electroluminescence element according to the potential difference between the data voltage charged in the capacitor and the reference voltage. And, the plurality of switching TFTs receives the scan signal SCAN supplied through the gate line GL and the emission signal EM supplied through the emission line EL to charge the data voltage Vdata to the capacitor.

The electroluminescence display device 100 according to an embodiment of the present disclosure includes a gate driver 130, a data driver 140, an emission signal generator 150 and a timing controller 120 for controlling them to drive a display panel 110 including a plurality of pixels. Here, the emission signal generator 150 is configured to be able to adjust the duty ratio of the emission signal EM. For example, the emission signal generator 150 may include a shift register and a latch for adjusting the duty ratio of the emission signal EM. According to the emission control signal ECS generated by the timing controller 120, an emission signal generator 150 is configured to generate an emission signal having a first duty ratio supplied to the pixel driving circuit when the pixel driving circuit is driven at the first refresh rate and generate the emission signal having a second duty ratio supplied to the pixel driving circuit when the pixel driving circuit is driven at the second refresh rate different from the first refresh rate.

According to such configured pixel driving circuit, the brightness of the pixel can be maintained when the driving of a pixel is changed from one refresh rate to another refresh rate, thus, perceptible image deterioration phenomenon can be reduced by expressing the uniform brightness of the pixel regardless of the driving refresh rate.

And, in various embodiments, the emission signal generator 150 may be configured to sequentially change the second duty ratio for a plurality of intervals in one frame period when switching from the first refresh rate to the second refresh rate. Here, one frame may be divided into a plurality of frame counters. The emission signal generator 150 may be configured to generate the emission signal according to the second duty ratio which is determined based on at least one of a duty ratio variable application factor, a factor that determines whether the duty ratio variable is negative or positive and a factor for a number of lines to be added or subtracted, with respect to each of the plurality of counters. The generation of the emission signal having the second duty ratio will be described later with reference to FIG. 8.

Figure 2:
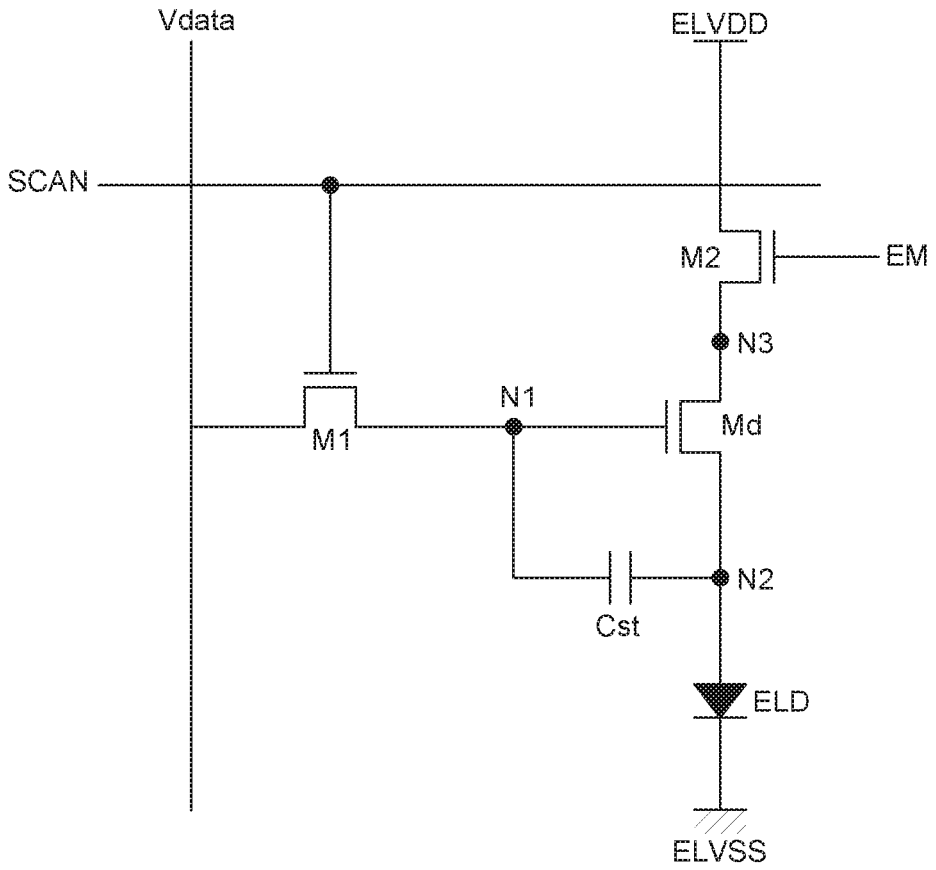
FIG. 2 is an exemplary circuit diagram of a pixel driving circuit of an electroluminescence display device according to an embodiment of the present disclosure.

FIG. 2 is an exemplary circuit diagram of a pixel driving circuit of an electroluminescence display device according to an embodiment of the present disclosure.

Referring to FIG. 2, the pixel driving circuit includes a driving TFT Md, switching TFTs (M1, M2), and a capacitor Cst. Here, the TFT is an example of one of the switching elements. Hereinafter, the driving switching element is referred to as a driving TFT and the switching element is referred to as a switching TFT. And, FIG. 2 is merely illustrative of the pixel driving circuit for the sake of explanation, and is not limited as long as it is a structure capable of controlling the emission of the electroluminescence element ELD by applying the emission signal EM. For example, the pixel drive circuit may include a switching TFT connected to an additional scan signal, a switching TFT receiving an additional initialization voltage and a connection relationship of the switching elements and a connection position of the capacitor may be variously arranged. If the emission of the electroluminescence element ELD is controlled in accordance with a change in duty ratio of the emission signal EM, and the emission can be controlled according to the refresh rate, a pixel driving circuit having various structures can be used. For example, various pixel driving circuits such as 3T1C, 4T1C, 6T1C, 7T1C, and 7T2C can be used. Hereinafter, an electroluminescence display device having the pixel driving circuit of FIG. 2 will be described for convenience of explanation.

The driving TFT Md includes a gate N1 connected to the capacitor Cst, a drain N2 connected to the electroluminescence element ELD and a source N3 connected to the second switching TFT M2. Here, the driving TFT Md is electrically connected to the electroluminescence element ELD, and is electrically connected between the high potential supply line ELVDD and the low potential voltage supply line ELVSS.

The first switching TFT M1 includes a gate connected to the scan signal line SCAN, a source connected to the data voltage line and a drain connected to the gate N1 of the driving TFT Md.

The second switching TFT M2 includes a gate connected to the emission signal line EL, a source connected to the high potential supply line ELVDD, and a drain connected to the source N3 of the driving TFT Md.

The capacitor Cst is connected between the gate N1 of the driving TFT Md and the drain N2 of the driving TFT Md.

In detail, when a high voltage higher than a threshold voltage (hereinafter referred to as Vth) is applied to the gate N1 of the driving TFT Md, the driving TFT Md is turned on, the source N3 of the driving TFT Md is electrically connected to the high potential supply line ELVDD, and the drain N2 of the driving TFT Md is electrically connected to the electroluminescence element ELD. Thus, when the voltage of the gate N1 of the driving TFT Md is higher than Vth, the driving TFT Md supplies the driving current Ids to the electroluminescence element ELD to emit the electroluminescence element ELD.

When a high voltage is applied through the scan signal line SCAN, the switching TFT M1 is turned on to supply the data voltage Vdata from the data voltage line to the first node N1.

When a high voltage is applied through the emission signal line EL, the second switching TFT M2 is turned on to supply a high potential voltage from the high potential supply line ELVDD to the source N3 of the driving TFT Md.

The capacitor Cst stores the difference between the voltage of the gate N1 of the driving TFT Md and the voltage of the drain N2 of the driving TFT Md. And, a high voltage is applied through the emission signal line EL so that the capacitor Cst stores the voltage between the gate N1 of the driving TFT Md and the drain N2 of the driving TFT Md. Here, the voltage stored in the capacitor Cst may be Vth.

With respect to the pixel driving circuit of the electroluminescence display device according to an embodiment of the present disclosure, the emission signal EM has a duty ratio determined in accordance with the refresh rate, and thus even if the same data voltage is applied, the current flowing time in one frame period through the electroluminescence element ELD may differ depending on the refresh rate. The specific operation of each pixel driving circuit according to the input-output signals applied to the pixel driving circuit will be described later with reference to FIG. 5 to FIG. 8.

In one example, (a) of FIG. 3A is a graph illustrating a change in brightness according to a voltage drop in a pixel of an electroluminescence display according to an embodiment of the present disclosure.

The electroluminescent display device may have different characteristics depending on the compensation circuit to be applied. In general, when the refresh rate is low, the holding period of the voltage charged in the capacitor Cst becomes longer. Thus, due to the leakage current in the off-state of the TFT, the brightness (e.g., luminance) of the pixel gradually decreases according to the leakage current. Here, (a) of FIG. 3A illustrates that the brightness of a pixel decreases due to leakage current when the electroluminescence element emits light with 10 nits of white light. The x-axis of (a) and (b) of FIG. 3A represents time domain, and the y-axis represents brightness expressed by a percentage. Referring to FIG. 3A, it is shown that the brightness gradually decreases due to the leakage current at a brightness of 100%. This phenomenon may appear significantly when the refresh rate of the pixel is reduced. For example, in a pixel driving at a frequency of 1 Hz than at a pixel driving at 60 Hz, the brightness reduction of the pixel due to the leakage current is larger in proportion to the time. Therefore, when the pixel is driven by adjusting the refresh rate from 60 Hz to 1 Hz, there may be a perception difference in terms of brightness of the pixel even if the pixel is driven to display the same brightness.

On the other hand, when the refresh rate is increased, a decrease in brightness due to a leakage current is relatively small. Therefore, the perceived brightness increases as the refresh rate increases. As the number of frames displayed per second increases, the frequency of the initialization period, which occurs in each frame, increases. Referring to (b) of FIG. 3A, it is shown that the brightness of a pixel decreases from 100% to about 81% during an initialization period in one frame. As the refresh rate increases, the frame per second increases and the number of the initialization periods also increase. Thus, the leakage current is reduced thereby the degree of brightness change of the pixel is reduced.

According to the above-described phenomenon, the brightness change of the pixel measured as the refresh rate varies is shown in the graph of FIG. 3B. Here, (b) of FIG. 3A is a graph showing a change in brightness according to the refresh initialization in the electroluminescence display device. Referring to FIG. 3B, when the refresh rate of the electroluminescence display device is 60 Hz, the brightness is assumed to be 100%, and when the refresh rate is changed to 120 Hz, the brightness is increased by 2%. When driving at 30 Hz and 1 Hz, it can be seen that there is a brightness reduction of 5% and 7%, respectively, as compared with 60 Hz driving.

Such a difference in brightness between the refresh rates can be recognized as a flicker to the eye of the viewer and may be recognized as an image deterioration phenomenon at the time when the refresh rate changes. The electroluminescence display device according to an embodiment of the present disclosure compensates the brightness difference between the refresh rates by adjusting the duty ratio of the emission signal so that the image deterioration phenomenon can be reduced at the time when the refresh rate changes.

FIG. 4 is a schematic flowchart illustrating a driving method of an electroluminescence display according to an embodiment of the present disclosure. First, the pixel driving circuit is driven at the first refresh rate (S410). When the pixel driving circuit is driven at the first refresh rate, the emission signal having the first duty ratio is supplied to the pixel driving circuit.

Next, the pixel driving circuit driven at the first refresh rate is switched to a second refresh rate different from the first refresh rate and driven (S420). An emission signal having a second duty ratio different from the first duty ratio is supplied to the pixel driving circuit when the pixel driving circuit is driven at the second refresh rate.

Since the driving circuit supplies a current to the electroluminescence element only when the emission signal is applied, thus, the brightness of the electroluminescence element can be controlled by adjusting the duty ratio of the applied emission signal. That is, the electroluminescence display device according to an embodiment of the present disclosure maintains the brightness of the electroluminescence device under various refresh rates conditions through pulse width modulation (PWM) driving of the emission signal. For the PWM driving, the emission signal can have the highest driving frequency that can be driven. And, the emission signal can have a driving frequency that is the least common multiple of the refresh rate while the refresh rate is variable. For example, the emission signal is constantly supplied at 240 Hz, which is the least common multiple of the drivable refresh rate, even if the refresh rate varies between 1 Hz and 240 Hz. If the driving frequency of the emission signal is smaller than the refresh rate, PWM driving may be substantially impossible. Hereinafter, driving of an electroluminescence display according to various embodiments of the present disclosure will be described with reference to FIG. 5 to FIG. 7.

FIG. 5 is an input-output waveform diagram of a vertical synchronization signal and an emission signal of an electroluminescence display according to an embodiment of the present disclosure. In one embodiment, the first refresh rate may be greater than the second refresh rate. In the exemplary input-output waveform diagram shown in FIG. 5, the first refresh rate in period A may be 60 Hz, and the second refresh rate in period B may be 1 Hz. In various embodiments, the second refresh rate may be one of 30 Hz, 10 Hz, 5 Hz, 4 Hz, 2 Hz and 1 Hz.

Referring to FIG. 5, a vertical synchronization signal (Vsync) is shown for distinguishing frames, and an emission signal (EVST) operating at 240 Hz is shown. The first duty ratio D1 of the emission start signal EVST in the period A driven at the first refresh rate of 10 Hz may be 60%. The second duty ratio D2 of the emission start signal EVST in the period B driven at the second refresh rate of 1 Hz is 85%, which may be greater than the first duty ratio. The second duty ratio D2 can be determined corresponding to the amount of voltage drop which relatively drops more when the pixel driving circuit is driven at the second refresh rate than when the driving circuit is driven at the first refresh rate. Thus, when the refresh rate is decreased, the brightness of the pixel, which can be reduced by the current leaking from the TFT or the like, can be compensated.

FIG. 6 is an input-output waveform diagram of a vertical synchronization signal and an emission signal of an electroluminescence display according to another embodiment of the present disclosure. In another embodiment, the first refresh rate may be less than the second refresh rate.

Referring to FIG. 6, a vertical synchronization signal (Vsync) is shown for distinguishing frames, and an emission signal (EVST) operating at 240 Hz is shown. The first duty ratio D1 of the emission start signal EVST in the period A driven at the first refresh rate of 10 Hz may be 60%. The second duty ratio D3 of the emission start signal EVST in the period B driven at the second refresh rate of 30 Hz is 30%, which may be smaller than the first duty ratio. The second duty ratio D3 can be determined corresponding to the decreasing voltage drop and the increasing initialization frequency when the pixel driving circuit is driven at the second refresh rate than when the driving circuit is driven at the first refresh rate. Thus, when the refresh rate is increased, the brightness of a pixel which is increased due to a TFT or the like can be compensated. In various embodiments, the second refresh rate may be 120 Hz or 240 Hz. In addition, the first refresh rate, which is the reference may, be 60 Hz.

FIG. 7 is an input-output waveform diagram of a vertical synchronization signal and an emission signal of an electroluminescence display according to an embodiment of the present disclosure. In various embodiments, the first refresh rate may be greater than the second refresh rate, and when the second refresh rate is applied, the second duty ratio of the emission start signal EVST may be gradually changed. And, for a gradual variation of the second duty ratio, one frame may have a plurality of frames, and a second duty ratio may be determined for each frame counter.

Referring to FIG. 7, a vertical synchronization signal (Vsync) is shown for distinguishing frames, and an emission signal (EVST) operating at 240 Hz is shown. The first duty ratio of the emission start signal EVST in the period A driven by the first refresh rate may be 60%. In the period D driven with the second refresh rate smaller than the first refresh rate, the emission start signal EVST may have a duty ratio D1 of 60% for the counters 1 and 2, a duty ratio D4 of 70% for the counters 3 and 4, and a duty ratio D5 of 85% for the counters 5 and 6. According to various embodiments of the present disclosure the image quality can be improved by sequentially applying the change in brightness so that the viewer does not recognize changes of the refresh rates as much as possible.

FIG. 8 is a schematic diagram for explaining pulse width modulation (PWM) of a light-emitting pixel when a refresh rate is varied in an electroluminescence display according to various embodiments of the present disclosure.

The timing controller of the electroluminescence display device according to the embodiments of the present disclosure may generate an emission control signal to vary the PWM duty ratio of the emission signal for a specific frame when operating in the VRR. The emission control signal is transmitted to the emission signal generator, and can generate the emission signal corresponding to the refresh rate. For example, the timing controller may be configured to generate the emission control signal so that the emission signal has a duty ratio corresponding to the refresh rate based on at least one of a duty ratio variable application factor, a factor that determines whether the duty ratio variable is negative or positive, and a factor for a number of lines to be added or subtracted. Here, the duty ratio variable application factor may represent a frame counter to which the duty ratio variable is to be applied. The factor that determines whether the duty ratio variable is negative or positive, is negative (−) or positive (+) as shown in FIG. 8 may indicate a factor for increasing or decreasing the duty ratio from the reference duty ratio. In addition, the number of lines to be added or subtracted may be a factor indicating duty ratio is to be increased (by D6) or decreased (by D7) with a certain degree. The emission signal generator generates an emission signal having a duty ratio corresponding to the refresh rate in accordance with the emission control signal having such a factor. With such a configuration, when the driving of the pixel is changed from one refresh rate to another refresh rate, the brightness of the pixel can be maintained, and thus, substantially the same brightness can be expressed regardless of the driving refresh rate. Consequently, image deterioration can be reduced.

In other words, the characteristics of the leakage current and the initialization period according to the refresh rate may differ depending on the characteristics of the respective electroluminescence display devices. That is, a particular electroluminescence display device may further include a specific compensation algorithm. Therefore, the duty ratio of the emission period can be varied variously due to the timing of the algorithm. However, since the above-described characteristics are measurable for each product, even if the present disclosure further includes various compensation algorithms, the concept of the present disclosure can be easily practiced.

FIG. 9 is a graph showing a change in brightness of a pixel when changing the refresh rate in an electroluminescence display according to various embodiments of the present disclosure. In this example, (a) of FIG. 9 shows the brightness measured at, for example, a pixel operating at 60 Hz. The x-axis represents the time domain and the y-axis represents the brightness in percentage. The pixel whose emission signal is driven by PWM exhibits the same brightness as the graph shown in (a) of FIG. 9 at 60 Hz. When the pixel is driven at 60 Hz and then driven at 10 Hz, the duty ratio of the emission signal is set so that the brightness has a width of D1, and gradually changes to have a width of D4 and D5. The brightness of the emitting pixels can be determined by the width of the graph of FIG. 9. In (b) of FIG. 9, as the leakage current increases, the graph is gradually lowered, so that the width of each pulse increases. On the other hand, in (a) of FIG. 9, the brightness increases again for each frame due to a high refresh rate. In (b) of FIG. 9, the height of the pulse is gradually decreased, but the width of the pulse is gradually increased as described above, so that the decrease in brightness can be compensated. Consequently, the overall brightness as shown in (a) and (b) of FIG. 9, may be substantially equal. That is, the amount of light emitted when driving at 60 Hz and when the pixel is driven at 10 Hz can be made substantially similar. Thus, the viewer can have a continuous feeling at the time of refresh rate conversion, and the flicker may not be recognized.

The embodiments of the present disclosure can also be described as follows:

According to an aspect of the present disclosure, an electroluminescence display device may comprise an electroluminescence element in each of a plurality of pixels, a pixel driving circuit driving the electroluminescence element, a gate driver and a data driver generating signals for driving the pixel driving circuit to be switchable between a first refresh rate and a second refresh rate different from the first refresh rate, and an emission signal generator generating an emission signal having a first duty ratio supplied to the pixel driving circuit when the pixel driving circuit is driven at the first refresh rate and generating the emission signal having a second duty ratio different from the first duty ratio, supplied to the pixel driving circuit when the pixel driving circuit is driven at the second refresh rate.

The first refresh rate may be smaller than the second refresh rate and the first duty ratio may be greater than the second duty ratio.

The second duty ratio may be determined according to frequencies of initializations that are increased when the pixel driving circuit is driven at the second refresh rate compared to when the pixel driving circuit is driven at the first refresh rate.

The second refresh rate may be 120 Hz or 240 Hz.

The first refresh rate may be greater than the second refresh rate and the first duty ratio may be smaller than the second duty ratio.

The second duty ratio may be determined according to a degree of voltage drops increased when the pixel driving circuit is driven at the second refresh rate compared to when the pixel driving circuit is driven at the first refresh rate.

The second refresh rate may be one among 30 Hz, 10 Hz, 5 Hz, 4 Hz, 2 Hz and 1 Hz.

The emission signal generator may be further configured to sequentially change the second duty ratio for a plurality of intervals in one frame period when refresh rate is switched from the first refresh rate to the second refresh rate.

The one frame period may be divided into a plurality of frame counters, and the emission signal generator is further configured to generate the emission signal for each of the plurality of frame counters according to the second duty ratio which is determined based on at least one of a duty ratio variable application factor, a factor that determines whether the duty ratio variable is negative or positive and a factor for a number of lines to be added or subtracted.

The emission signal may have a highest driving frequency that can be driven.

The emission signal may have a driving frequency which is a least common multiple of a refresh rate when the pixel driving circuit is operated at the first refresh rate or the second refresh rate.

According to another aspect of the present disclosure, a driving method of an electroluminescence display device may include an electroluminescence element arranged in each of a plurality of pixels and a pixel driving circuit for driving the electroluminescence element, the method comprising driving the pixel driving circuit at a first refresh rate, supplying an emission signal having a first duty ratio to the pixel driving circuit when the pixel driving circuit is driven at the first refresh rate, driving the pixel driving circuit by switching the pixel driving circuit driven at the first refresh rate to a second refresh rate different from the first refresh rate and supplying an emission signal having a second duty ratio different from the first duty ratio to the pixel driving circuit when the pixel driving circuit is driven at the second refresh rate.

The first refresh rate may be greater than the second refresh rate and the first duty ratio may be smaller than the second duty ratio.

The second duty ratio may be sequentially changed for a plurality of intervals in one frame period when refresh rate is switched from the first refresh rate to the second refresh rate.

The one frame period may be divided into a plurality of frame counters and the second duty ratio is adjusted for each of the plurality of frame counters based on at least one of a duty ratio variable application factor, a factor that determines whether the duty ratio variable is negative or positive and a factor for a number of lines to be added or subtracted.

Although the embodiments of the present disclosure have been described in detail with reference to the accompanying drawings, the present disclosure is not limited thereto and may be embodied in many different forms without departing from the technical concept of the present disclosure. Therefore, the embodiments of the present disclosure are provided for illustrative purpose only but not intended to limit the technical concept of the present disclosure. The scope of the technical concept of the present disclosure is not limited thereto. The protective scope of the present disclosure should be construed based on the following claims, and all the technical concepts in the equivalent scope thereof should be construed as falling within the scope of the present disclosure.

What is claimed is:

1. An electroluminescence display device comprising:

an electroluminescence element in each of a plurality of pixels;

a pixel driving circuit configured to drive the electroluminescence element;

a gate driver and a data driver configured to generate signals for driving the pixel driving circuit to be switchable between a first refresh rate and a second refresh rate different from the first refresh rate; and an emission signal generator configured to generate an emission signal having a first duty ratio supplied to the pixel driving circuit when the pixel driving circuit is driven at the first refresh rate, and generate the emission signal having a second duty ratio different from the first duty ratio, supplied to the pixel driving circuit when the pixel driving circuit is driven at the second refresh rate, wherein the emission signal generator determines the second duty ratio corresponding to a degree of voltage drops and frequencies of initializations that are changed when the pixel driving circuit is driven at the second refresh rate compared to when the pixel driving circuit is driven at the first refresh rate so that a brightness of the pixel is maintained, and wherein the emission signal has a driving frequency which is constant when the pixel driving circuit is operated at the first refresh rate or the second refresh rate.

2. The electroluminescence display device of claim 1, wherein the first refresh rate is lower than the second refresh rate, and the first duty ratio is greater than the second duty ratio.

3. The electroluminescence display device of claim 2, wherein the second refresh rate is 120 Hz or 240 Hz.

4. The electroluminescence display device of claim 1, wherein the first refresh rate is higher than the second refresh rate, and the first duty ratio is smaller than the second duty ratio.

5. The electroluminescence display device of claim 4, wherein the second refresh rate is one among 30 Hz, 10 Hz, 5 Hz, 4 Hz, 2 Hz and 1 Hz.

6. The electroluminescence display device of claim 4, wherein the emission signal generator is further configured to sequentially change the second duty ratio for a plurality of intervals in one frame period when refresh rate is switched from the first refresh rate to the second refresh rate.

7. The electroluminescence display device of claim 6, wherein the one frame period is divided into a plurality of frame counters, and wherein the emission signal generator is further configured to generate the emission signal for each of the plurality of frame counters according to the second duty ratio which is determined based on at least one of a duty ratio variable application factor, a factor that determines whether the duty ratio variable is negative or positive and a factor for a number of lines to be added or subtracted.

8. The electroluminescence display device of claim 1, wherein the driving frequency of the emission signal is a least common multiple of a refresh rate.

9. A driving method for an electroluminescence display device including an electroluminescence element arranged in each of a plurality of pixels and a pixel driving circuit for driving the electroluminescence element, the driving method comprising:

driving the pixel driving circuit at a first refresh rate;

supplying an emission signal having a first duty ratio to the pixel driving circuit when the pixel driving circuit is driven at the first refresh rate;

driving the pixel driving circuit by switching the pixel driving circuit driven at the first refresh rate to a second refresh rate different from the first refresh rate; and supplying an emission signal having a second duty ratio different from the first duty ratio to the pixel driving circuit when the pixel driving circuit is driven at the second refresh rate, wherein the second duty ratio is determined corresponding to a degree of voltage drops and frequencies of initializations that are changed when the pixel driving circuit is driven at the second refresh rate compared to when the pixel driving circuit is driven at the first refresh rate so that a brightness of the pixel is maintained, and wherein the emission signal has a driving frequency which is constant when the pixel driving circuit is operated at the first refresh rate or the second refresh rate.

10. The driving method of claim 9, wherein the first refresh rate is higher than the second refresh rate, and the first duty ratio is smaller than the second duty ratio.

11. The driving method of claim 10, wherein the second duty ratio is sequentially changed for a plurality of intervals in one frame period when refresh rate is switched from the first refresh rate to the second refresh rate.

12. The driving method of claim 11, wherein the one frame period is divided into a plurality of frame counters, and wherein the second duty ratio is adjusted for each of the plurality of frame counters based on at least one of a duty ratio variable application factor, a factor that determines whether the duty ratio variable is negative or positive and a factor for a number of lines to be added or subtracted.

13. An electroluminescence display device comprising:

an electroluminescence element in each of a plurality of pixels;

a pixel driving circuit driving the electroluminescence element;

a gate driver and a data driver generating signals for driving the pixel driving circuit to be switchable between a first refresh rate and a second refresh rate different from the first refresh rate; and an emission signal generator generating an emission signal having a first duty ratio supplied to the pixel driving circuit when the pixel driving circuit is driven at the first refresh rate, and generating the emission signal having a second duty ratio different from the first duty ratio, supplied to the pixel driving circuit when the pixel driving circuit is driven at the second refresh rate, wherein the emission signal generator determines the second duty ratio corresponding to a degree of voltage drops and frequencies of initializations that are changed when the pixel driving circuit is driven at the second refresh rate compared to when the pixel driving circuit is driven at the first refresh rate so that a brightness of the pixel is maintained, wherein the one frame period is divided into a plurality of frame counters, and wherein the emission signal generator is further configured to generate the emission signal for each of the plurality of frame counters according to the second duty ratio which is determined based on a duty ratio variable application factor, a factor that determines whether the duty ratio variable is negative or positive and a factor for a number of lines to be added or subtracted, and wherein the emission signal has a driving frequency which is constant when the pixel driving circuit is operated at the first refresh rate or the second refresh rate.

14. The electroluminescence display device of claim 13, wherein the first refresh rate is lower than the second refresh rate, and the first duty ratio is greater than the second duty ratio.

15. The electroluminescence display device of claim 14, wherein the second refresh rate is 120 Hz or 240 Hz.

16. The electroluminescence display device of claim 13, wherein the first refresh rate is higher than the second refresh rate, and the first duty ratio is smaller than the second duty ratio.

17. The electroluminescence display device of claim 16, wherein the second refresh rate is one among 30 Hz, 10 Hz, 5 Hz, 4 Hz, 2 Hz and 1 Hz.

18. The electroluminescence display device of claim 16, wherein the emission signal generator is further configured to sequentially change the second duty ratio for a plurality of intervals in one frame period when a refresh rate of the pixel driving circuit is switched from the first refresh rate to the second refresh rate.

19. The electroluminescence display device of claim 13, wherein the driving frequency of the emission signal is a least common multiple of a refresh rate.

* * * * *